United States Patent [19]

Kakizaki et al.

[11] 4,373,293

[45] Feb. 15, 1983

[54] TOY RACING GAME

[75] Inventors: Katsumi Kakizaki; Michihiro Kozuka, both of Tokyo, Japan

[73] Assignee: Tomy Kogyo Co., Inc., Tokyo, Japan

[21] Appl. No.: 180,866

[22] Filed: Aug. 25, 1980

[30] Foreign Application Priority Data

Oct. 23, 1979 [JP] Japan ..... 54-147243[U]

[51] Int. Cl.[3] ..... A63H 18/00

[52] U.S. Cl. ..... 46/206; 273/86 R; 46/202

[58] Field of Search ..... 46/1 K, 39, 202, 206; 273/86 D, 86 R

[56] References Cited

U.S. PATENT DOCUMENTS

| | | | |
|---|---|---|---|
| 2,160,738 | 5/1939 | Horn | 46/39 |
| 2,832,177 | 4/1958 | Mueller | 46/202 X |
| 3,548,534 | 12/1970 | Beny et al. | 46/1 K |
| 3,696,555 | 10/1972 | Bales et al. | 46/202 |
| 3,707,805 | 1/1973 | Buck | 46/202 |
| 3,735,526 | 5/1973 | Ensmann et al. | 46/202 |
| 3,750,328 | 8/1973 | Nielsen et al. | 46/1 K |
| 4,070,024 | 1/1978 | Hamanso | 273/86 D |
| 4,260,041 | 4/1981 | Mabuchi | 46/206 X |

FOREIGN PATENT DOCUMENTS

| | | | |
|---|---|---|---|
| 550677 | 5/1932 | Fed. Rep. of Germany | 46/202 |
| 1104215 | 6/1955 | France | 46/202 |
| 2060415 | 5/1981 | United Kingdom | 46/206 |

*Primary Examiner*—F. Barry Shay

*Attorney, Agent, or Firm*—K. H. Boswell; Edward D. O'Brian

[57] ABSTRACT

A toy racing game includes at least one vehicle powered by a windup spring motor and a track on which the vehicle runs. The vehicle includes an exposed winding member which when rotated winds up the spring motor. An energizing station is located in association with the track and this station is capable of interacting with the vehicle winding member to wind the spring motor. The energizing station includes an engagement mechanism which moves out from the station and contacts the vehicle to retain the vehicle in association with the station. The engagement mechanism includes a retaining member which so retains the vehicle and a motion transfer member which engages with the winding member on the vehicle. Rotation of the motion transfer member is transferred to the winding member to energize the vehicle's spring motor. The vehicle is allowed to propel itself on the track when the engagement mechanism moves away from the vehicle back towards the station.

14 Claims, 10 Drawing Figures

10
12
14
16
22
24
26
28
30
32
34
36
38
40
46
82
100
102
8
9
10

22
152
156
182
34
18
174
20
100
30
32
96
98
102
92
94
182
34
24
112A
26
14
60
58
56
56
16

TOY RACING GAME

BACKGROUND OF THE INVENTION

This invention is directed to a racing game which utilizes an energizing station. The energizing station is capable of engaging with a spring powered vehicle to wind the spring and thus energize the vehicle.

Windup spring motor powered vehicles have been known for many years. However, they still find utility in many contemporary toy vehicles. They have many advantages over many contemporary toy vehicles. Paramount among these advantages is the fact that they do not require batteries or transformers for their use. Many parents feel that small children especially should not play with electric powered vehicles. Further, most of these vehicles are rendered completely useless and therefore of little play value when the child is either using them away from a convenient plug, such as out of doors, or if the batteries have lost their charge and thus are useless.

Electric powered vehicles such as electric trains and slot car race sets do, however, allow the child a degree of remote control. With these vehicles a permanent or semipermanent track layout can be set up and the vehicles, especially slot cars, can be used in a competitive manner with a parent or a friend. A more realistic play situation can be envisioned by the child when he does not have to continuously pick his vehicle up to wind it.

Attempts have been made in the past to mimic the above positive aspects of the electric powered vehicle. Included in these would be vehicle and track layouts such as that shown in U.S. Pat. No. 3,548,534. In this patent certain toy vehicles are caused to move around track layouts by propelling the vehicles via an endless belt which has a plurality of engagement members on its surface. When the vehicle is positioned over the endless belt it is engaged by the engaging fingers and moved forward by the endless belt. At the end of the endless belt the vehicle leaves with a certain momentum which is capable of propelling the vehicle on the track. However, as soon as the vehicle leaves the belt rolling friction starts to decelerate the vehicle and hopefully sufficient momentum has been imparted to the vehicle to bring it back to a position over the endless belt to again cause it to accelerate.

In U.S. Pat. No. 3,696,555 a toy hill climbing vehicle is described. This vehicle receives it momentum from a catapult-like device which thrusts the vehicle forward with sufficient velocity to climb up an upwardly inclined section of track representing a hill. As with the toy noted in the preceding paragraph friction soon overcomes the momentum imparted to the vehicle by the catapult action causing the vehicle to decelerate. Of course, friction is augmented also by the pull of gravity, because the vehicle is going up a hill.

In U.S. Pat. Nos. 3,735,526 and 3,750,328 there are described two winding mechanisms which engage with or couple with a windup vehicle allowing the vehicle to be energized. In the "526" patent winding is accomplished via a reentrant-type clutch mechanism which is attached to a winding handle. The winding handle is located below the clutch mechanism. This placement necessitates lifting of both the vehicle and the winding mechanism off of the surface on which the vehicle is to travel in order to manipulate the winding mechanism. This type of winding mechanism is obviously therefore not suited for use with a continuous track in that if the housing is mounted to the continuous track both the housing and the track would have to be lifted in order to wind the vehicle. The "328" patent describes a winding mechanism or lever on the side of the housing. As noted in the "328" patent, to utilize this mechanism the vehicle must be placed on the platform. By so having to place the vehicle on the platform the realistic effect of a race wherein the players of the game never have to touch the vehicle is lost.

BRIEF SUMMARY OF THE INVENTION

In view of the above discussion it is therefore a broad object of this invention to provide an improvement in a toy race game of the type using windup spring motor vehicles which do not require physical contact with the vehicles by the players in any manner in order to energize the spring motor of the vehicles. It is a further object of this invention to provide a toy race game which can be used in a competitive manner between players and which requires the player to judge when the vehicle needs recharging and thus introduces an element of suspense into the race game which is analogous to actual race conditions wherein the driver must judge his fuel consumption. It is a further object of this invention to provide a race game which, because of its engineering principles, can be soundly constructed in an economical manner to to yield a game capable of extended use yet economical to the consumer.

The objects listed above as well as others which will be evident from the remainder of this specification are achieved in a toy racing game incorporating a windup spring motor powered vehicle which rides on a track which comprises: said vehicle including a winding member operatively connected to said spring motor and capable of winding said spring motor if acted on by an external source; a vehicular energizing station located in association with said track and capable of interacting with said vehicle winding member to wind the spring motor in said vehicle; said vehicular energizing station including vehicle engagement means movably mounted on said station between a first position wherein said vehicle is free to pass by said station on said track without interacting with said station and a second position wherein said vehicle is engaged by said vehicle engagement means and is retained at said station; said vehicle engagement means including a vehicle retention member located in association with a rotary motion transfer member, said vehicle retention member capable of engaging said vehicle when said engagement means is in said second position and positioning said rotary motion transfer member in operative engagement with said winding member; means to rotate said rotary motion transfer member.

In the preferred embodiment the vehicle engagement means moves horizontally between the first and second positions and includes an extension-retraction means operatively associated with the retention member and the rotary motion transfer member to move both of these horizontally with respect to the energizing station. The means to rotate the rotary motion transfer member includes a hand held crank means capable of being rotated by the operator of the game and connected to the rotary motion transfer member by a connecting means which allows it to be held at a position distal from the energizing station and thus separates the energizing station by some distance from the operator of the toy.

The connecting means preferably includes a gear means located in the energizing station and a cable attaching between the crank means and the gear means. The rotary motion transfer member is operatively attached to the gear means. Further, the gear means can include a clutch capable of preventing overwinding of the spring motor in the vehicle.

BRIEF DESCRIPTION OF THE DRAWINGS

This invention will be better understood when taken in conjunction with the drawings attached hereto wherein.

DETAILED DESCRIPTION

Figure 1:
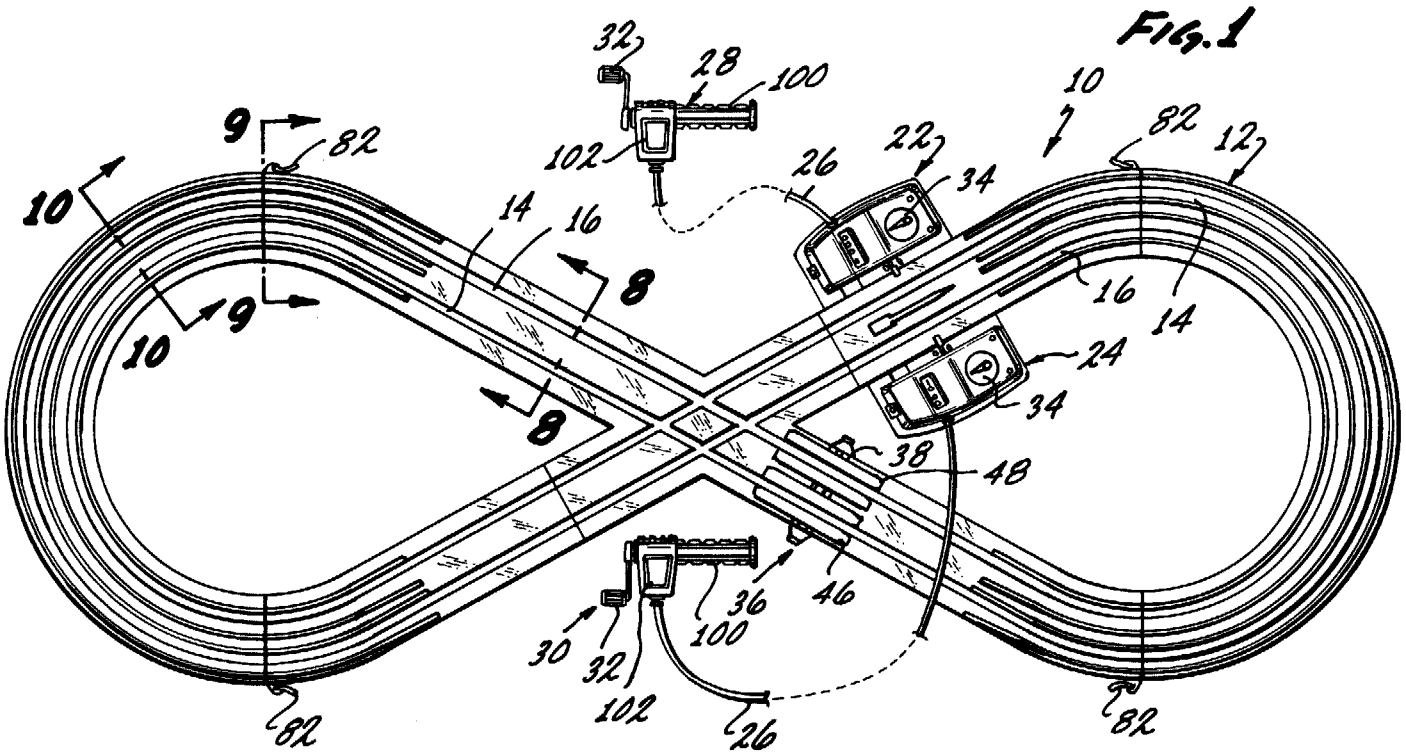
FIG. 1 is a top plan view of the invention excluding the vehicles of the invention.

The toy racing game 10 of the invention outwardly consists of several main components. The first of these is the track 12 which contains two separate vehicle pathways 14 and 16. The track is generally laid out in a figure 8 pattern such that pathway 14 on the left hand side of the track has a smaller radius than pathway 16, but on the right hand side of the track has a larger radius than pathway 16. This results in the length of the two pathways 14 and 16 being equal when considered from the point of view of starting at one point and traversing the entire pathway and returning to the same point.

Two vehicles 18 and 20, which are identical in all respects except color and decorative indicia, are located one on each of the respective pathways 14 and 16. Two vehicle energizing stations 22 and 24 are located on respective sides of the track 12, one next to pathway 14 and the other next to pathway 16. Attaching to each of the stations 22 and 24 via flexible cables, collectively identified by the numeral 26, are hand held cranks 28 and 30. Each of the energizing stations 22 and 24 are of similar internal construction except for being mirror images of each other and the inclusion of one extra axle and pinion, hereinafter identified, within station 24. Mechanically the cranks 28 and 30 are equivalent to each other in all respects. The vehicles 18 and 20 are also mechanically equivalent to each other in all respects.

In the interest of brevity of this specification, only one of the cranks, crank 28 and only one of the vehicles, vehicle 18 will be described in great detail. Further like numbers will be utilized for like components in stations 22 and 24 whenever referring to identical components. Where necessary to distinguish between like components for one reason or the other, like components between stations 22 and 24 will be followed by an identifying alphabetical letter, a being used for station 22 and b being used for station 24.

Before describing the detailed construction of the game 10, a brief description of how the game is played will facilitate a better understanding of the components. In playing the game 10 it is an object, if two players are competing against each other, to complete a prescribed number of laps by one of the vehicles 18 and 20 around the track 12 before the opponent utilizing the other vehicle does. Each of the vehicles 18 and 20 contain a spring motor as hereinafter described. These spring motors can be wound by retaining the appropriate vehicle 18 or 20 within the appropriate energizing station 22 or 24 as hereinafter described and winding the spring motor of the vehicle by turning the handle 32 forming a part of each of the cranks 28 or 30. Once the spring motor is energized the vehicles 18 or 20 can be released from the energizing stations 22 or 24 as hereinafter described by manipulating the crank 28 or 30 in an appropriate manner freeing the respective vehicles 18 or 20 to travel around their pathways 14 or 16. Each time the respective vehicles 14 or 16 pass through or by their energizing station 22 or 24 an indication that that vehicle has successfully completed one lap of the track 12 is automatically indicated on lap counters collectively identified by the numeral 34 and located on the energizing stations 22 and 24. If during travel around the track 12, however, the vehicles 18 or 20 starts to slow down the player in control of that vehicle knows that it will be necessary to retain his vehicle 18 or 20 at the appropriate energizing station 22 or 24 the next time the vehicle passes the energizing station to reenergize the spring motor. Thus, in effect a pit stop is necessary.

During actual play of the game players never actually need to touch their vehicles 18 or 20 if they appropriately time their pit stops such that they never leave their vehicles stranded somewhere along the track 12 with its spring motor completely wound down. To futher add a more realistic effect simulating a motocross type race a removable jump ramp 36 can be used on the track 12.

Figure 7:
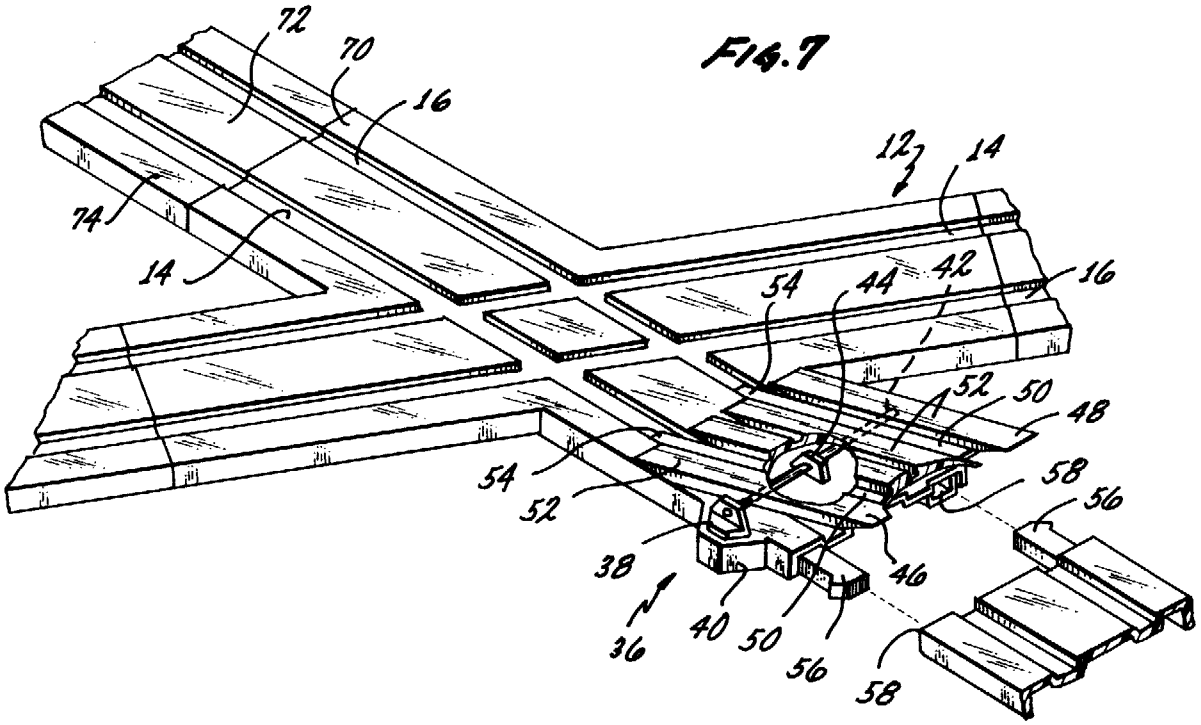
FIG. 7 is an isometric view in partial section and partially exploded showing the central track portion of FIG. 1.

The jump ramp 36 consists of a base plate 38 which has appropriate tabs not shown or numbered projecting downwardly from its respective ends which fit into holes, not shown or numbered, located in identical projections 40 projecting out of the left and right side of the track 12. This fixedly holds the jump ramp 36 to the track 12 but also allows for its removal in case the game is to be played without using the jump ramp 36. An axle 42 extends across the jump ramp 36 and is appropriately mounted to upstanding projections collectively identified by the numeral 44 located on the base plate. Two ramps 46 and 48 are individually pivotally mounted to axle 42. Both of these ramps are essentially first class levers wherein the fulcrum point is located closer to one end. Because of this, one end is heavier and descends downwardly under the influence of gravity as shown in FIG. 7, however, each of the ramps 46 and 48 are free to pivot about axle 42 if and when one of the vehicles 18 or 20 travels up the ramp to the opposite side of the fulcrum point causing a shift in the center of gravity of the combined ramp and vehicle such that the ramp pivots about axle 42. In effect, the ramps 46 and 48 could each be compared to a teeter-totter having unequal lengths of its individual sides. Each of the individual ramps 46 and 48 is free to pivot independent of the other.

As will be more fully explained hereinafter, each of the vehicles pathways 14 or 16 contain a groove bounded on either side by a ledge (not identified or numbered at this time). Each of the ramps 46 and 48 mimic this configuration. Both of the ramps 46 and 48 have a centralized groove collectively identified by the numeral 50 bounded by elevated sections, collectively identified by the numeral 52. On the short end of the ramps 46 and 48 tongues collectively identified by the numeral 54 extend from the bottom of groove 50 and fit into the grooves in the track such that the grooves between the track and the ramp are continuous.

As hereinafter explained each of the vehicles 18 or 20 has a speed control. If the vehicles 18 or 20 go across the jump ramps 46 and 48 at a slow speed the ramps are prone simply to tip and thus constitute what could be best described as a pivotal bump. When the vehicles 18 or 20 traverse the track 12 at a higher speed, however, instead of simply causing the individual ramps 46 or 48 to tilt as the vehicles traverse it the ramp, in effect the speed of the vehicle, can impart an upward momentum to the vehicle causing the vehicle to actually become airborne coming completely free of the track 12. The vehicle, of course, quickly descends under the influence of gravity back to the surface of the track 12.

Figure 2:
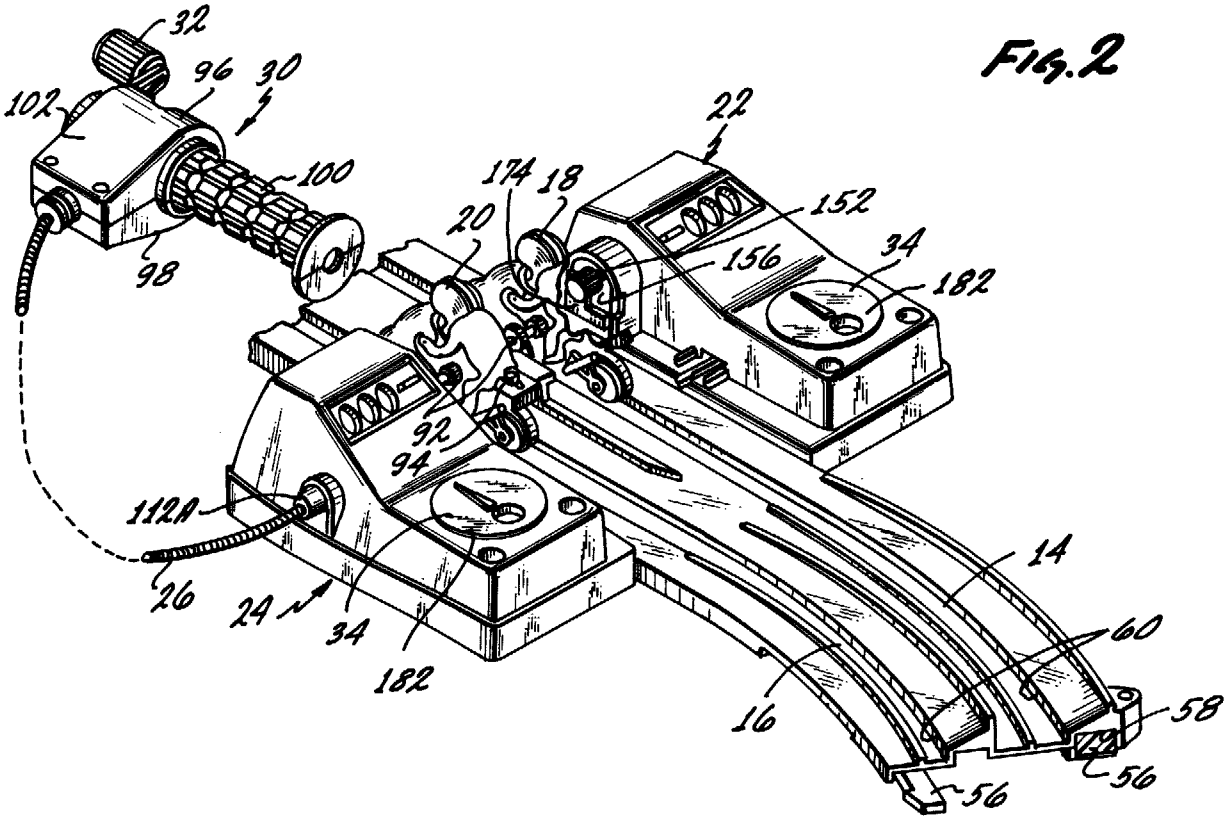
FIG. 2 is an isometric view of a portion of the invention including the vehicles of the invention but excluding sections of the track portion of the invention.
Figure 9:
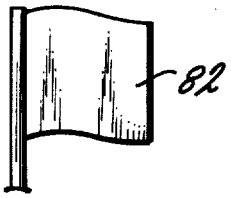
FIG. 9 is a side elevational view in section taken about the line 9—9 of FIG. 1.
Figure 10:
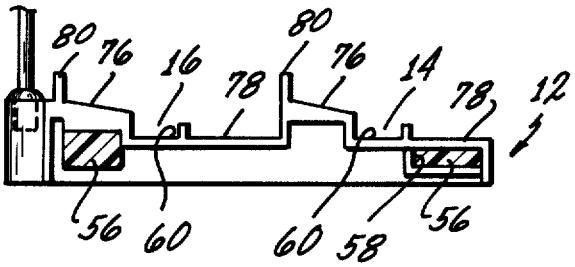
FIG. 10 is a side elevational view in section taken about the line 10—10 of FIG. 1.
Figure 10:
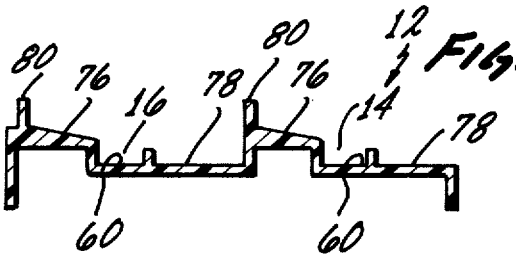

The track 12 is composed of a plurality of sections which interlink into one another to form the completed structure. These different sections (not separately numbered or identified) are somewhat different in shape and function depending upon their location. The central section (not separately identified) is X shaped allowing the two pathways 14 and 16 to cross over themselves and each other. The sections on the right and left of the figure 8 which are curved and which can be seen in section in FIGS. 9 and 10 have certain components which are banked, i.e. oriented at an oblique angle with respect to the horizon to overcome certain centrifugal forces. This helps to maintain the vehicles 18 and 20 on the track 12 as these vehicles go through the curved sections. In any event all of the sections interlock via a mortise and tenon like locking mechanism. The ends of certain of the sections of track are shown in FIGS. 2 and 7. Further, both FIGS. 8 and 9 show in cross section the joining of two track sections.

On the end of each of the track sections on one side there is located a pinion type projection 56. On the opposite side is a cavity or mortise type recession 58. The projections 56 and the cavities 58 are identically located on each of the track sections such that each two adjoining track sections are locked by the projection 56 of one section fitting into the cavity 58 of the other section concurrently with the projection 56 of the other section fitting into the cavity 58 of the first section. An exploded view of this is shown in FIG. 7. In FIGS. 8 and 9 the projection 56 is shown located within the cavity 58 on the right hand side, however, as is evident from FIGS. 2 and 7, the cavities 58 are recessed slightly from the edge of the track section and therefore since views 8 and 9 are taken along a line right along this edge these cavities do not show up on the left hand side. Further, in those areas wherein two sections meet along a straight portion of the track 12 the projections 56 on both sides of the sections are of an equal thickness as is evident in FIG. 8, but in those areas wherein curved sections meet curved sections, as is evident from FIG. 9 the projection 56 on the outside of the track or left hand side of FIG. 9 is thicker than the projection on the inside track or right hand side of FIG. 9. This fact is also evident by comparing FIGS. 2 and 7. As will be explained hereinafter in more detail and as was alluded to before, the curved sections contain banked areas and the purpose of these unequal sized projections 56 insures proper alignment of the banked areas (the track sections cannot be put together backwards.)

A groove, collectively identified by the numeral 60 extends around the center of each of the vehicular pathways 14 and 16. To the right and left of this groove the track 12 is elevated. The grooves 60 provide a track for the front wheel 62 and the rear wheel 64 of each of the vehicles 18 and 20. Projecting outward on both the left and right hand sides of the vehicles 18 and 20 are free-wheeling disks collectively identified by the numeral 66. Each of these disks are mounted on the ends of a boss 68 by a pin (not shown or numbered) which allows them to freely spin. The bosses 68 hold the disks to both the right and left of the wheels 62 and 64, but spaced upwardly from the lowermost point of the wheels 62 and 64 such that when the wheels 62 and 64 are appropriately located in the groove 60 the disks 66 contact the elevated portions of the track. This stabilizes the vehicles 18 and 20 in an upright position.

Figure 8:
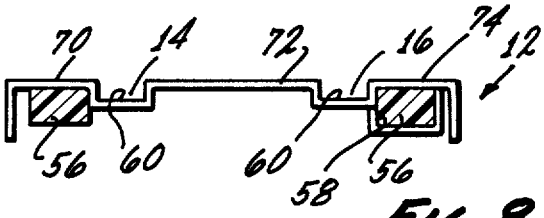
FIG. 8 is a side elevational view in section taken about the line 8—8 of FIG. 1.

As seen in FIGS. 7 and 8 in those areas of the track 12 which are flat, the elevated areas form a left side area 70, a central area 72 and a right side area 74. The central area 72 is positioned between the left and right groove 60. In the curved section, as is shown in side view in FIGS. 9 and 10 and in isometric in FIG. 2, for each of the pathways 14 and 16 the grooves 60 are located between an obliquely slanting area 76 and a flat area 78. There is thus two oblique areas 76 and two flat areas 78 one each for both the pathways 14 and 16. When rounding a curved section the angle of oblique area 76 combined with it being elevated with respect to flat area 78 causes the vehicles 18 and 20 to incline toward the inside of the curve. The disk 66 on the outside of the vehicle is raised up by the oblique area 76 and the disk 66 on the inside of the vehicle is allowed to descend downwardly such that it is rolling on the flat area 78 which is at the same elevation as the bottom of the groove 60. Additionally in the curved section on the outside of both of the oblique areas 76 there is a rail 80 which also tends to maintain the vehicles 18 and 20 within their appropriate pathway 14 or 16. The disk on the outside of the vehicle tends to ride next to the rail 80 as the vehicle goes around the curved section. Appropriate flags 82 are also located on certain of the curved sections for decorative effects.

Figure 5:
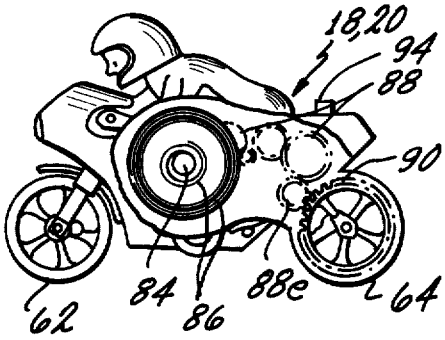
FIG. 5 is a side elevational view in partial section of the vehicle component of the invention.

Reference will be made now to the vehicle as best seen in FIG. 5. A shaft 84 extends transversely through the center of each of the vehicles 18 and 20. Internally within each of these vehicles a flat spirally coiling spring 86 winds around shaft 84. The shaft 84 is appropriately coupled to rear wheel 64 by a plurality of drive gears collectively identified by the numeral 88. The gears 88 appropriately govern the speed and direction of rotation of the rear wheel 64. They ultimately interact with gear 90 which is located around the perimeter of rear wheel 64 as is seen in the figures.

Located on both of the exposed ends of shaft 84 are small spur gears 92. When these spur gears are rotated, as hereinafter described, shaft 84 is rotated winding spring 86 about it. The last gear **88*e* in the gear train 88 which contacts gear 90 is a swing gear which appropriately disengages from gear 90 during the winding of spring 86 but engages gear 90 as it unwinds. This gear 88e thus serves as a clutch allowing the spring 86 to be wound without movement of the rear wheel 64 but causing rotation of rear wheel 64 as spring 86 unwinds. This is necessary to allow the vehicles 18 and 20 to be parked at their respective energizing stations 22 and 24 during winding of their springs 86**.

A speed governing lever 94 is located behind each one of the figures (not numbered) on the vehicles 18 and 20. The levers 94 interact with a butterfly spring not shown or numbered which presses against rear wheel 64. When the lever 94 is pushed rearward toward the rear of the vehicle 18 or 20 the tension on this spring is released allowing rear wheel 64 to freely spin under the influence of spring 86. When the lever 94 is shifted forward the unseen spring pushes against rear wheel 64 causing a slight amount of drag between it and the rear wheel 64 which slightly slows down the rotation of the rear wheel 64. This results in the vehicles 18 and 20 being able to travel at two different speeds.

Each of the cranks 28 and 30 are composed of an upper and lower housing 96 and 98 respectively. They mate together to form a hollow structure and are held together by appropriate screws (not numbered). Each of the cranks 28 and 30 contain a grip section 100 suitably sized to fit conveniently within the hand of a child and a hollow housing section 102. The handles 32 extend out of the housing 102 opposite the grip 100. This allows the player to hold onto the grip 100 with one hand and conveniently turn the handle 32 with the other hand.

Figure 6:
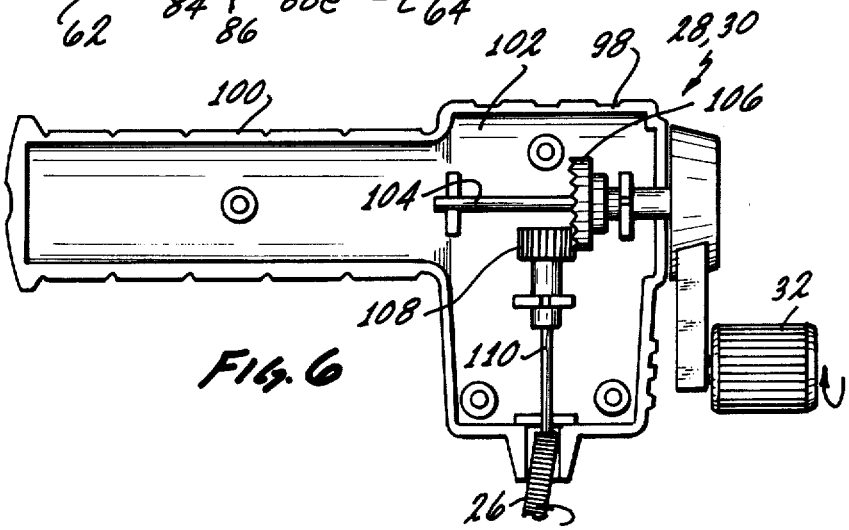
FIG. 6 is a side elevational view in partial section of the crank handle shown in both FIGS. 1 and 2.

In FIG. 6 the upper crank housing 96 has been removed to expose the components inside. Handle 32 is fixedly connected to an axle 104 appropriately journaled within the housing 102. A crown wheel 106 is also fixed to axle 104 and therefore rotates in response to rotation of handle 102. A pinion 108 meshes with crown wheel 106. Pinion 108 is fixedly located on axle 110 which is also fixedly located onto one of the ends of flexible cables 26. The axle 110 is appropriately journaled to housing 102 such that rotation of pinion 108 results in rotation of flexible cable 26. It can thus be seen that when the handle 32 is turned this results in rotation of flexible cable 26. It can also be seen (and the importance of this will be noted later) that rotation of the handle 32 in one direction results in rotation of the flexible shaft in a first direction while rotation of the handle in the opposite direction results in rotation of the cable in the opposite direction. The ability to reverse the rotation of the flexible cable 26 allows a player of the game to control two separate functions in the energizing stations 22 and 24 simply by selecting the direction of rotation of flexible cable 26. Since the cable 26 is connected to the handle 32 ultimately the functions of the stations 22 and 24 are controlled by the direction of rotation of the handle 32.

Figure 3:
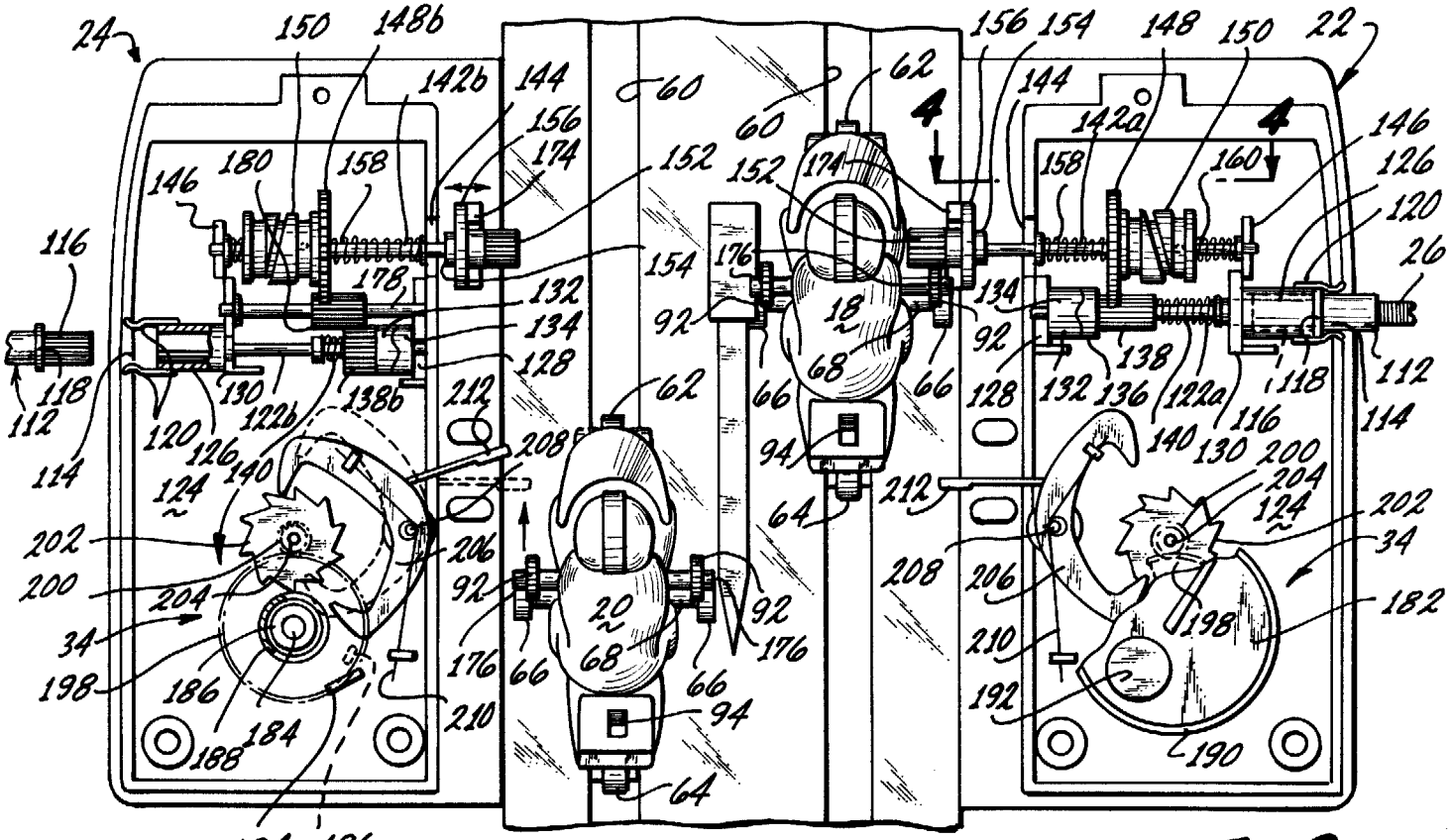
FIG. 3 is a top plan view in partial section showing certain portions of the invention depicted in FIG. 2.
Figure 4:
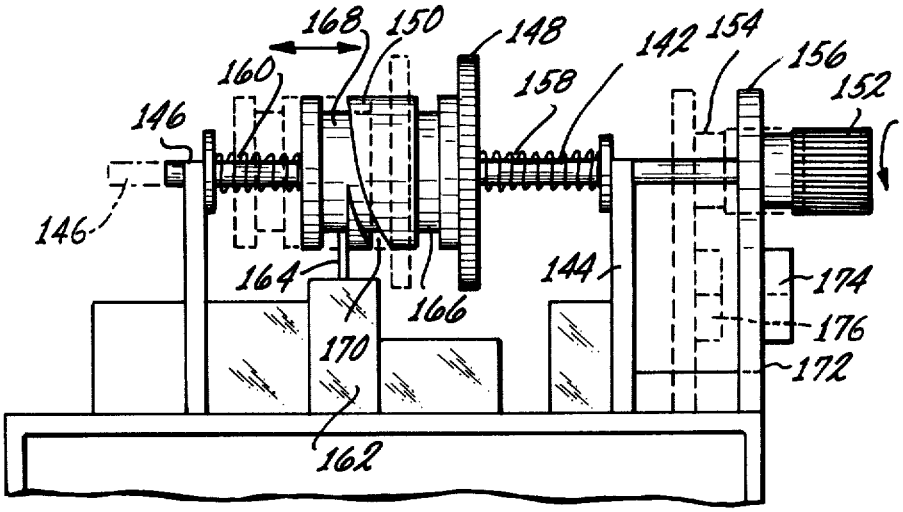
FIG. 4 is a side elevational view in both solid and phantom lines taken about the line 4—4 of FIG. 3.

As can be seen in FIGS. 3 and 4 flexible cables 26 attach to energizing stations 22 and 24 via insertion of end 112 of the cables 26 into openings 114 in the energizing stations 22 and 24. The end 112 of the flexible cable 26 culminates in an elongated pinion 116 which is fixedly attached to the flexible cable 26 and rotates with respect to rotation of it. A flange 118 encircles the inside ends of pinion 116 and when the pinion 116 is inserted into the opening 114 the flange 118 becomes locked by spring clip 120 fixedly holding the end 112 within the opening 114 in a manner allowing rotation of the pinion 116 with the flexible cable 26.

A first axle 122 is appropriately journaled to the base 124 of the energizing station 22. The end of this axle immediately adjacent opening 114 has mounted on it an internal pinion 126 (that is a hollow boss having inwardly projecting gear teeth). Pinion 116 is sized to fit in and mesh with internal pinion 126 to transfer rotary motion of flexible cable 26 to rotary motion of axle 122. Axle 122 is appropriately journeled between upstanding projection 128 and upstanding projection 130 both projecting upwardly from base 124 and both having appropriate bearing surfaces (not identified or numbered) traversing through them in which axle 122 is received and is free to rotate thereon.

On the end of axle 122 opposite internal pinion 126 is slip clutch 132. Slip clutch 132 has a first member 134 which is fixedly located on axle 122 and rotates with it and a second member 136 which is mounted around axle 126 and is free to spin thereon. Fixedly formed with second member 126 is elongated pinion 138 and it too freely rotates about axle 122. The adjacent surfaces on first and second members 134 and 136 are both serpentine allowing them to mate as seen in FIG. 3. They are however free to slip past one another should one or the other of these members be fixedly held and the other rotated because of axial movement of member 136 on axle 122.

A spring 140 is compressed in between elongated pinion 138 and the upstanding projection 130. This spring biases the combinaton of the elongated pinion 138 and the second member 132 against the serpentine surface of the first member 134. Normally the tension of the spring 140 is sufficient to insure that rotation of one of the members 136 and 134 will result in rotation of the other. Should, however, one of these members be fixed in a position such that it cannot rotate and the other of these members is rotated, the serpentine surfaces of the members 134 and 136 slide past one another alternately compressing and releasing the tension of the spring 140. Spring 140 thus serves to maintain the serpentine surfaces of the members 134 and 136 together except when one or the other of these is held fixed.

The slip clutch 132 prevents overwinding of the spring motor in the vehicles 18 and 20. If, in fact, the spring 86 within these vehicles is completely wound, as will be seen in the next paragraph, pinion 138 is no longer free to rotate and thus rotation of flexible cable 26 is not transferred to pinion 138 because of the slip clutch 132.

Axle 142 is located parallel to axle 122. It is mounted between upstanding projections 144 and 146 which project upwardly from base 124. Fixedly mounted in the center of axle 124 is a unitary circular member (not separately numbered) having a spur gear 148 as its first component and a drum 150 as its second component. Fixedly located on the end of axle 142 outside of the energizing station 22 is a pinion 152. Spaced away from pinion 152 is a retaining ring 154 which is also fixedly located to axle 142. Placed in between pinion 152 and retaining ring 154 is retention member 156. Retention member 156 has an opening (not shown or numbered in the drawings) which is oversized with respect to axle 142 such that axle 142 can pass through it without imparting any rotary movement to it.

Located about axle 142 between projection 144 and spur gear 148 is spring 158. Located between projection 146 and drum 150 is spring 160. Axle 142 is free to slide back and fourth axially in its mounting in both projections 146 and 144. As it slides back and forth axially all of the components fixedly attached to it, that is pinion 152, retaining ring 154, spur gear 148 and drum 150, move with it as well as retaining member 156 which is locked between pinion 152 and retaining ring 154. The springs 158 and 160 tend to position axle 142 in a particular position referred to as the rest position if it is not influenced by any outside forces. This rest position is essentially governed by an equalization of tension between the two springs 158 and 150.

As seen in FIG. 4, located beneath drum 150 is an upstanding boss 162. Projecting upwardly from boss 162 is a pin 164. Drum 150 has three grooves machined into its surface. The first of these, groove 166, extends circumferentially around the drum 150 proximal to spur gear 148. The second groove, groove 168, extends circumferentially around drum 150 distal from spur gear 148. The third groove, spiral groove 170, spirals along the cylindrical surface of drum 150 between grooves 166 and 168. It connects into and is continuous with both of these grooves as can be seen in FIG. 4. The elevation of the end of pin 164 is such that the pin 164 must be located within one of the three grooves 166, 168 or 170. When the axle 142 is in its rest position the pin 164 is, in fact, located about midway in spiral groove 170.

Because pin 164 is located at all times within one of the three above mentioned grooves the position of drum 150 and therefore axle 142 is governed by which groove the pin 164 is located in. It was noted above that in the rest position the pin 164 is in spiral groove 170. If, in fact, drum 150 is caused to rotate when pin 164 is in the spiral groove 170 drum 150 will have to move (as viewed in FIG. 4) either to the right or left because of the spiral nature of spiral groove 170. By turning the drum 150 in one direction the drum will rotate and move laterally in a first direction forcing the pin 164 to be relocated from groove 170 into the groove 166 where it will stay as long as the same direction of rotation is maintained. By turning the drum 150 in the opposite direction the drum will have to shift laterally in the other direction forcing the pin to be located in groove 168 where it will stay as long as the drum continues rotating the opposite direction. If the drum 150 goes in one direction it, of course, tenses spring 158. If it goes in the other direction it tenses spring 160. If the rotation of the drum 150 in either direction ceases the drum 150 is biased towards the rest position by which ever of the springs 158 or 160 are tensed. When this happens, as soon as pin 164 is located next to one or the other of the openings wherein spiral groove 170 opens into and meets the groove 166 or 168 the drum will move laterally in conjunction with its rotational movement such that the pin is repositioned in the spiral groove 170. Thus if the pin 164 is in the groove 166 and the direction of the rotation of the drum 150 in a first direction is reversed to the other direction, the in 164 will be relocated into the spiral groove 170 and from there be relocated into the other groove 168. This, of course, works vice versa going from groove 168 to groove 166 for reversal of the direction of rotation of the drum 150 from the other direction to the first direction.

Pinion 138 mates with spur gear 148. Rotation of flexible shaft 26 is therefore transferred to spur gear 148, drum 150, axle 142 and pinion 152. However, depending upon which direction flexible cable 26 is rotated axle 142 and all components attached thereto move back or forth horizontally with respect to the energizing station 22. This results in pinion 152 and retaining member 156 moving out toward groove 60 when flexible cable 26 rotates in one direction and moving inward away from groove 60 upon rotation of flexible cable 26 in the opposite direction.

The horizontal movement of pinion 152 is appropriately coupled to its rotational movement such that it will extend toward groove 60 when it, in fact, is rotating in a direction such that if it meshes with spur gears 92 on one or the other of the vehicles 18 or 20 the direction of rotation of pinion 152 will, in fact, cause the spring 86 within the vehicle to be wound. Conversely if pinion 152 is rotating in a direction which would unwind spring 86 pinion 152 is drawn back toward the energizing station 22 in a position that is cannot engage with spur gear 92.

As noted above along with the back and forth movement of pinion 152 depending upon the direction of rotation of flexible cable 26, retention member 156 simultaneously moves back and forth with pinion 152. On the face 172 of retention member 156 facing groove 60 an L shaped hook 174 is positioned. Shafts 84 of the vehicles 18 and 20 extends slightly beyond the spur gears 92 located on them, i.e. there is a small extension 176 of shaft 84 which is exposed beyond the spur gears 92. The hook 174 on face 172 of retention member 156 is horizontally positioned with respect to the track 12 such that if the retention member 156 (and also the pinion 152) is extended out from the energizing station 22 toward the groove 60, the extension 176 of shaft 84 will be trapped by the hook 174 retaining the vehicle 18 adjacent to the energizing station 22. Concurrently with the retention of extension 176 within the hook 174 pinion 152 meshes with gear 92. When the flexible cable 26 is rotated in the opposite direction and retention member 156 withdraws back into the energizing station 22 then the hook 174 is no longer in position to retain extension 176.

From the above it can be seen that if the player controlling a particular vehicle such as vehicle 18 believes that the spring motor in his vehicle needs reenergizing he simply has to rotate the handle 32 of the crank 28 in a first direction which causes rotary motion to be transferred by the flexible cable 26 to the energizing station 22. This will extend both the retention member 156 and pinion member 152 toward groove 60. When the particular vehicle 18 passes by the energizing station 22 it is retained there by the hook 174 interacting with the extenion 176 and further spur gear 92 engages pinion 152. Continued rotation of the handle 132 in this same first direction then winds the spring 86 within the vehicle 18. After the spring has been sufficiently wound as indicated by either slipping of the slip clutch 132 or resistence in turning the handle 32 the handle is then turned in the opposite direction withdrawing the retention member 156 and pinion 152 back in toward the energizing station 22 allowing the vehicle 18 to then continue around the track 12.

The other energizing station 24 works exactly in the same manner as the energizing station 22 except that as seen in FIG. 3, since it is on the left hand side an additional axle 178 having a pinion 180 located thereon is utilized within it. Since both of the cranks 28 and 30 are identical and can be used interchangeably between the two energizing stations 22 and 24 it is necessary to include this additional axle 178 and pinion 180. The cranks 28 and 30 would, of course, contain indicia thereon indicating which direction of rotation of the handles 32 results in winding of the spring motors of the vehicles and which direction results in release of the vehicles from the energizing station. The two cranks 28 and 30 could, of course, be individualized such that one of them fits only energizing station 22 and the other fits only energizing station 24, however, this is not preferred. It is easier to, in fact, include the extra axle 178 with energizing station 24 to reverse the direction of rotation of pinion 152.

Axle 178 is appropriately mounted inside of energizing station 24 between axle **122*b* and 142*b*. Pinion 180 engages both pinion 138*b* and spur gear 148*b*. By thus introducing an extra pinion between gears 138*b* and 148*b* the direction of rotation of axle 142*b* compared to 122*b* is reversed compared to axle 122*a* with 142*a***.

Each of the energizing stations 22 and 24 are equipped with a lap counter 34 which are identical with respect to each other except for the physical position of one component noted below. An indicator wheel 182 having a pointer thereon is mounted on axle 184 which fits into an appropriate bearing surface not numbered in an upstanding boss 186 projecting upwardly from base 124. A spring 188 is mounted about boss 186 and pushes upwardly on the bottom of indicator wheel 182. The indicator wheel 182 is maintained within the appropriate energizing station by a flange 190 which fits underneath the top of the energizing station. The spring 188, however, urges the indicator wheel 182 upwardly pushing the flange 190 against the top of the energizing station.

There is a finger hole 192 on the indicator wheel 182 which allows the operator to turn the wheel back to zero. Whenever the operator's finger is located within the finger hole the indicator wheel 182 is pushed downwardly against the bias of spring 188 toward the base 124. Projecting upwardly from the base 124 is a stop 194. Located on the underside of the indicator wheel 182 is a second stop 196. When the indicator wheel 182 is pushed downwardly by the presence of a finger in the finger hole 192 stop 196 is positioned such that it will be retained by stop 194. If, however, no finger is present in the finger hole 192 the spring 188 pushes the indicator wheel 182 upwardly to where stop 196 is lifted above stop 194 and will not interact. The stops 194 and 196 are correctly positioned such that they interact when the pointer on the indicator wheel 182 is at zero.

On the bottom of the indicator wheel 182 is a spur gear 198. This spur gear 198 interacts with a pinion 200 which is formed on the surface of an escapement wheel 202. Pinion 200 and escapement wheel 202 therefore rotate together. Escapement wheel 202 is appropriately rotatably mounted on an axle 204 projecting upwardly from the base 124. An escapement arm 206 is positioned on the base 124 such that it is capable of engaging escapement wheel 202. The escapement arm 206 is mounted about axle 208 projecting upwardly from base 124 and it includes a butterfly spring 210 which urges it to the position shown in phantom lines for energizing station 24 in FIG. 3. An activator arm 212 is fixedly attached to escapement arm 202. Whenever one of the vehicles 18 or 20 passes the energizing station next to the pathway the vehicle is traveling on the disk 66 bump against the activator arms 212 causing them to move from the position shown in solid lines for energizing station 24 in FIG. 3. Since the arms 212 are fixedly attached to the escapement arms 206 the escapement arms 206 also move from the position shown in phantom lines to the position shown in solid lines. When the vehicle has passed the arms 212 the butterfly spring 210 returns the escapement arm to its original position causing movement of the escapement wheel 202 to be communicated to the indicator wheel 182.

We claim:

1. An improvement in a toy racing game incorporating a wind up spring motor powered vehicle which rides on a track which comprises:

said vehicle including a winding member operatively connected to said spring motor and capable of winding said spring motor if acted on by an external source;

a vehicular energizing station located in association with said track and capable of interacting with said vehicle winding member to wind the spring motor in said vehicle;

said vehicular energizing station including vehicle engagement means movably mounted in said station between a first position wherein said vehicle is free to pass by said station in said track without interacting with said station and a second position wherein said vehicle is engaged by said vehicle engagement means and is retained at said station;

said vehicle engagement means including a rotary motion transfer member, said rotary motion transfer member being capable of operatively engaging said winding member for winding said spring motor when said vehicle engagement means is in said second position;

rotary motion means capable of being operated by an operator of said game and producing a rotary output in response to said operation;

connecting means operatively connecting said rotary motion means to said rotary motion transfer member transferring said rotary output of said rotary motion means to said rotary motion transfer member to move said vehicle engagement means between said first and said second positions when said rotary motion transfer member is rotated and to supply rotary motion to said winding member when said vehicle is at said energizing station and said vehicle engagement means is in said second position.

2. The game of claim 1 wherein:

said rotary motion means is capable of producing both a clockwise and a counterclockwise rotatory output and said vehicle engagement means moves from said first position to said second position in response to one of said clockwise or said counterclockwise rotatory outputs and and from said second position to said first position in response to the other of said clockwise or counterclockwise rotatory outputs.

3. The game of claim 2 wherein:

said vehicle engagement means further includes a vehicle retention member located in association with said rotary motion transfer member, said vehicle retention member capable of engaging said vehicle when said vehicle engagement means is in said second position.

4. The game of claim 3 wherein:

said vehicle engagement means moves horizontally between said first and said second position;

said vehicle engagement means includes extension-retraction means operatively associated with said rotary motion transfer member and capable of extending and retracting said rotary transfer member horizontally with respect to said energizing station.

5. The game of claim 4 wherein:

said rotary motion means includes a hand held crank means capable of being rotated by an operator of the game.

6. The game of claim 5 wherein:

said connecting means includes gear means located in said energizing station and cable means operatively attached to said crank means and said gear means to transfer motion from said crank means to said gear means;

said rotary motion transfer member is operatively connected to said gear means.

7. The game of claim 6 wherein:

said gear means includes a clutch means capable of preventing overwinding of said spring motor in said vehicle.

8. The game of claim 7 wherein:

said extension-retraction means includes an axle mounted in said energizing station such that it is capable of moving axially in a horizontal plane towards and away from said track, a guide means located on said axle and fixed to said axle to move axially in response to axial movement of said axle, and a pin means located on said energizing station in operative association with said guide means, said pin means capable of imparting axial movement to said guide means and said axle in response to rotational movement of said axle.

9. The game of claim 8 wherein:

said rotary motion transfer member comprises an engagement gear located on the end of said axle and said vehicle retention member comprises a member capable of moving in response to axial movement of said axle and including a hook means capable of interacting with said vehicle to retain said vehicle in association with said energizing station.

10. The game of claim 9 wherein:

said guide means includes a drum, said drum including a cylindrical surface, said drum coaxially located on said axle and movable in response to both axial and rotational movement of said axle, said cylindrical surface of said drum having at least one groove extending inwardly toward the center of said drum, said groove formed as a helix extending around said cylindrical surface and coaxial with the axis of said axle;

said pin means capable of fitting within and interacting with said groove.

11. The game of claim 10 wherein:

said cylindrical surface of said drum includes three grooves extending inwardly toward the center of said drum, the first of said grooves formed as a helix extending around said cylindrical surface and coaxial with the axis of said axle, the second and third of said grooves extending circumferentially around said cylindrical surface of said drum and positioned with respect to said helical groove such that said helical groove is continuous with said second groove at one end of said helical groove and continuous with said third groove at the other end of said helical groove;

said pin means includes a pin fixedly mounted in said energizing station and located with respect to said drum such that at least a portion of said pin is located within one of said first, said second and said third grooves and is capable of moving reversibly between said second and third groove by passing through said first groove;

said axle moving axially with respect to movement of said pin within said first, second and third groove.

12. The game of claim 11 wherein:

said gear means includes a gear located on said axle such that rotational movement from said crank means is transferable to said axle and said drum mounted on said axle.

13. The game of claim 12 wherein:

said crank means includes a handle capable of being rotated both clockwise and counterclockwise;

said axle moving axially in said horizontal plane toward said track when said handle is turned in one of said clockwise or said counterclockwise directions and said axle moving away from said track when said handle is turned in the other of said clockwise or said counterclockwise directions.

14. The game of claim 13 wherein:

said rotary motion transfer member includes a gear mounted on said axle external said energizing station and capable of interacting with said vehicle winding member.

* * * * *